United States Patent [19]

Specht

[11] Patent Number: 4,492,539

[45] Date of Patent: Jan. 8, 1985

[54] VARIABLE DISPLACEMENT GEROTOR PUMP

[76] Inventor: Victor J. Specht, 197 S. Saginaw St., Pontiac, Mich. 48058

[21] Appl. No.: 459,957

[22] Filed: Jan. 21, 1983

Related U.S. Application Data

[63] Continuation-in-part of Ser. No. 250,341, Apr. 2, 1981, Pat. No. 4,413,960.

[51] Int. Cl.[3] ..... F04C 2/10; F04C 15/04

[52] U.S. Cl. ..... 418/19; 418/26; 418/27; 418/171

[58] Field of Search ..... 418/16, 19, 24–27, 418/166, 171

[56] References Cited

U.S. PATENT DOCUMENTS

| | | | |
|---|---|---|---|
| 2,490,115 | 12/1949 | Clarke | 418/166 |
| 2,588,032 | 3/1952 | O'Brien . | |
| 2,685,842 | 8/1954 | Hufferd | 418/26 |
| 2,898,862 | 8/1959 | Brundage . | |
| 3,007,418 | 11/1961 | Brundage . | |
| 3,022,741 | 2/1962 | Brundage | 418/171 |
| 3,728,048 | 4/1973 | Ratliff, Jr. . | |
| 4,097,204 | 6/1978 | Palmer | 418/19 |

FOREIGN PATENT DOCUMENTS

| | | |
|---|---|---|
| 2135861 | 2/1973 | Fed. Rep. of Germany . |
| 1426223 | 2/1976 | United Kingdom . |

*Primary Examiner*—John J. Vrablik

*Attorney, Agent, or Firm*—Cullen, Sloman, Cantor, Grauer, Scott & Rutherford

[57] ABSTRACT

A gerotor pump or rotary fluid power transmission having a displacement control device for changing the volume of fluid delivered. The displacement control device operates by changing the eccentric position between the inner and outer rotors. The inlet and outlet ports of the pump are kept separate to maintain a unidirectional flow from the inlet to the outlet port across open mesh crossover zone. The closed mesh crossover zone is moved relative to the open mesh crossover zone and maintains separation between the inlet and outlet ports. As the eccentric position of the outer rotor relative to the inner rotor is changed, the volume of fluid transferred from the inlet port to the outlet port over the open mesh crossover zone is varied between a minimum and maximum amount. In one embodiment, the displacement control device is manually shifted. In another embodiment the deplacement control device is hydraulically shifted to control the displacement of the pump in response to the increasing or decreasing demand of the hydraulic system supplied by the pump.

20 Claims, 12 Drawing Figures

FIG. 3
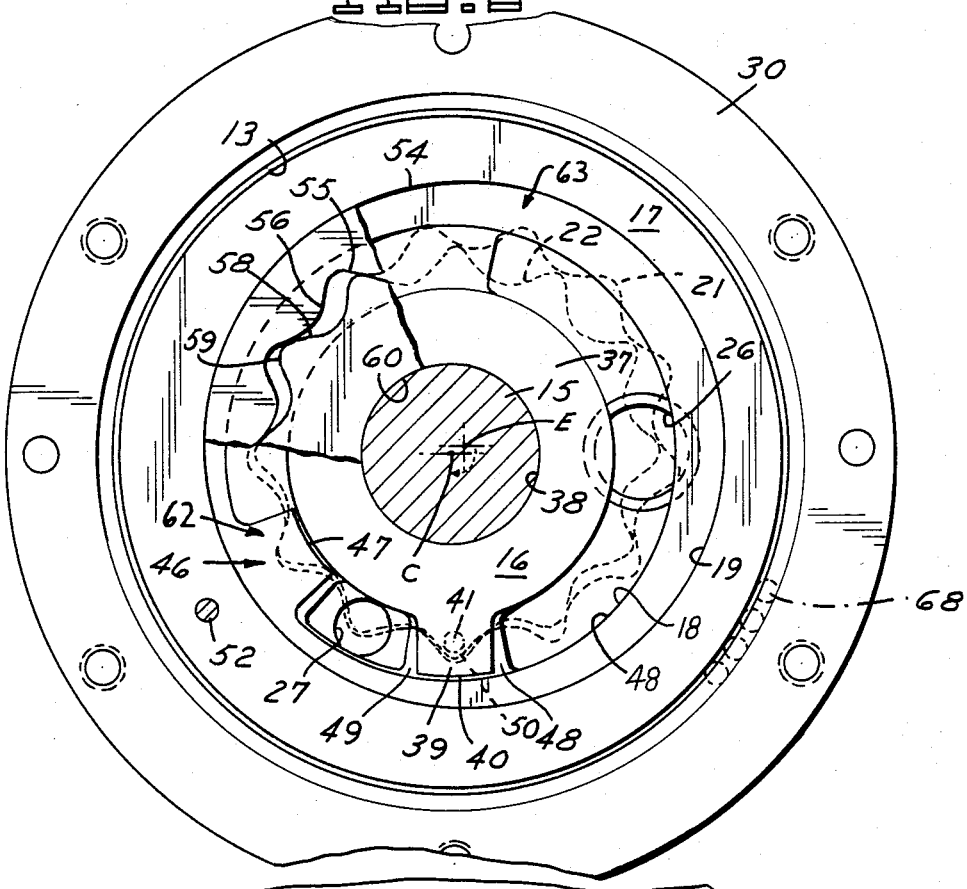
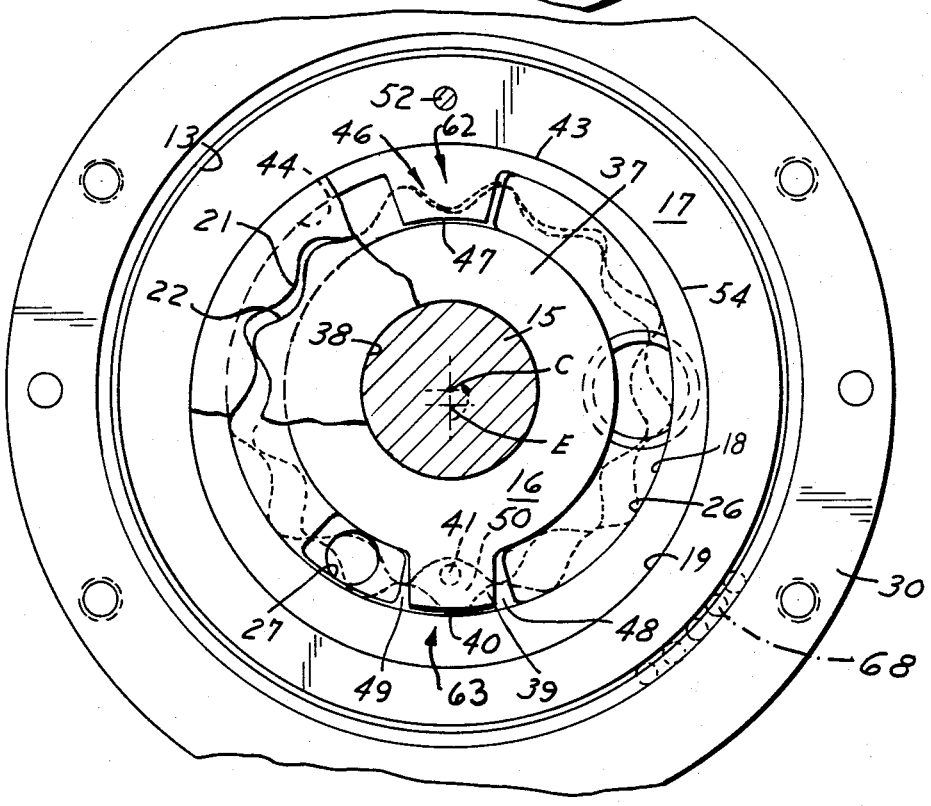
FIG. 4

VARIABLE DISPLACEMENT GEROTOR PUMP

RELATED APPLICATIONS

This application is a continuation-in-part of my prior application Ser. No. 250,341, filed Apr. 2, 1981, now U.S. Pat. No. 4,413,960.

BACKGROUND OF THE INVENTION

This invention relates generally to a rotary fluid power transmission in the form of a pump or motor, and more particularly concerns a variable displacement gerotor pump.

It is well known that conventional gerotor pumps are positive displacement pumps that are self-priming, lightweight and require no valves for operation. Gerotor pumps have long been used to pump impure fluids and are durable, long-wearing devices.

A conventional gerotor pump includes two pumping elements, referred to herein as an inner rotor and an outer rotor. The inner rotor is generally secured to a drive shaft and always has one less tooth than the outer rotor. As the inner rotor is rotated on the drive shaft, it advances one tooth space per revolution relative to the outer rotor. The outer rotor is rotatably retained in a housing, eccentric to the inner rotor, and meshing with the inner rotor on one side. As the inner and outer rotors turn from their meshing point the space between the teeth of the inner and outer rotors gradually increases in size through the first 180° rotation of the inner rotor, creating a partial vacuum therebetween. The fluid to be pumped is drawn from an inlet port into the enlarging space. During the last half of the revolution cycle, the space between the inner and outer rotors decreases in size as the teeth mesh and the fluid is forced from the space. As the space between the inner and outer rotors decreases in volume, it is open to an outlet port. The inlet and outlet ports are isolated from each other by the housing and the inner and outer rotors.

Such gerotor pumps are constant displacement pumps which yield a predetermined displacement per revolution. In many applications this is a desirable feature, however, in some applications it is desirable to change displacement without altering the speed of rotation of the drive shaft with a variable displacement pump.

While the advantages of a variable displacement pump are well known, prior art devices that have attempted to provide such a pump tend to be complex structures that are difficult to manufacture and subject to leakage or even failure. The degree of variability realizable in prior art gerotor pumps is severely limited. In particular, prior art variable displacement gerotor pumps are complex and are not generally as effective as other types of variable displacement pumps.

Conventional variable delivery gerotor pumps typically use a bypass to divert a portion of the fluid pumped from the fluid output channel of the pump to the reservoir or intake of the pump. The fluid may be either moved through a bypass channel or will flow internally from the outlet side of the pump to the inlet side. When variability is obtained by means of bypass, there is little power savings since the power requirement of the pump will remain the same even as delivery is reduced. If the fluid is permitted to flow internally from the outlet side of the pump to the inlet side, power is converted into heat which will build up in the fluid and pump, and will result in reduced service life of the fluid and pump. Many bypass systems also cause cavitation.

Another type of prior art mechanism used to create a variable delivery gerotor pump did so by restricting the outlet port of the pump. In this approach to the problem, restrictions in the outlet port result in excessive noise and vibration in the pump. Restricting the outlet causes fluid to be trapped in the pump which contravenes the traditional principles of fluid power engineering. Excessive noise and vibration in such devices is unacceptable in many applications and frequently will result in accelerated wear.

These and other disadvantages and limitations have been overcome in the present invention. While the simple and effective displacement control achieved by the present invention is best applied to gerotor pumps, it can also be applied to gear pumps, vane pumps, and other types of fluid rotary power transmissions including fluid rotary motors.

SUMMARY OF THE INVENTION

The present invention relates to a variable displacement gerotor pump which is simply constructed for dependability, durability, and ease of manufacture. Durability of the displacement control mechanism enhances the dependability of pumps made in accordance with the present invention. The component parts of the pump made in accordance with the present invention are not complex so they may be machined to close tolerances, thereby limiting the need for seals in many instances.

The variable displacement gerotor pump of the present invention achieves substantial power savings because the power requirement of the pump is reduced proportionately to the reduction in displacement required. The present invention provides variable displacement without bypassing excess fluid from the outlet port back to the inlet port or reservoir and prevents cross flow from the outlet side of the pump to the inlet side. Variable displacement is achieved without restricting the inlet flow or outflow of fluid from the pump.

The present invention is a pump of general application which is well suited for retrofitting into existing systems to provide additional pumping capacity.

The variable displacement gerotor pump of the present invention is a positive displacement pump which is self priming in its mimimum flow position. Most other types of variable displacement pumps such as a vane pump do not prime in their minimum flow positions which complicates start up of a machine using such pumps.

The variable displacement gerotor pump of the present invention is capable of providing a wide range of displacement volume per revolution ratios. Control of displacement may be provided by either a simple manual control or a hydraulic control system.

The manual pump control uses a lever which is connected to a positionable control device within the pump which simultaneously changes the effective size of the inlet and outlet ports without restriction of fluid flow and rotates the eccentric axis of the outer rotor about the central axis of the inner rotor to change the volume of fluid transferred by the pump from the inlet port to the outlet port.

The hydraulically controlled embodiment of the present invention comprises a hydraulic fluid channel formed in the positionable control device which includes fluid reaction members effective to rotate the positionable control device in one direction when fluid is injected into the channel. A biasing member is preferably provided in the channel to rotate the positionable control device in the opposite direction when fluid is withdrawn from the channel.

In one embodiment an automatic displacement adjusting pump is provided wherein the outlet port of the variable displacement gerotor pump is connected by a control fluid port to the channel in the positionable control device, so that an increase in demand on the pump results in a reduction in fluid pressure within the channel. Reduction of the fluid pressure in the channel causes the positionable control device to rotate to an increased flow position. Conversely, when the hydraulic system demand is reduced, the pressure in the outlet port increases. Increase in pressure is communicated to the channel through the control fluid port to shift the positionable control device to a reduced flow position.

According to the present invention, a pump is provided which has a housing including a cylindrical bore with a fluid inlet and a fluid outlet opening into the bore. A pump mechanism is rotatably nested within a positionable control device which is in turn nested within the cylindrical bore of the housing. The pump mechanism is nested within an eccentric inner diameter formed in the positionable control device. The pump mechanism includes an outer controlled member rotatably nested within the positionable control device and a power driven inner control member concentric with the cylindrical bore and eccentric to the outer controlled member. The inner control member, or inner rotor, engages the outer controlled member, or outer rotor, to provide a fluid pumping action, as previously described, between the fluid inlet and fluid outlet. The eccentric position of the outer controlled member relative to the inner control member may be varied by rotating the positionable control device to change the quantity of fluid pumped per revolution of the control members.

In another embodiment of the present invention, a variable displacement gerotor pump is provided in a pump housing having a cylindrical bore with a port plate at one end and a removable cover on the opposite end. The port plate includes a fluid intake port and a fluid outlet port. The inlet and outlet ports are separated at one circumferential location by a commutator which includes an annular portion and a lobe fixedly located on the surface of the port plate between the fluid inlet and outlet ports. A positionable control device, adapted to nest within the cylindrical bore, on the surface of the port plate, is arcuately shiftable relative to the commutator and has a lobe extending toward the commutator for providing a rotatable seal between the other end of the fluid inlet and outlet ports. A device for adjusting the positionable control device is provided to shift the pump between a maximum flow position and a minimum flow position. In this embodiment, the gerotor pump elements are positioned within the eccentric bore of the positionable control device so that the relative eccentricity of the inner and outer rotors is shifted when the positionable control device is rotated. In this way, the effective size of the outlet port and the location of the eccentric axis are simultaneously shifted by the positionable control device.

In a hydraulically controlled embodiment of the present invention, the positionable control device includes a fluid reaction chamber formed on the side of the positionable control device adjacent the housing. A rotatable reaction member is attached to the positionable control device and a stationary reaction member is attached to the housing. A channel or port is formed through the housing to supply and withdraw fluid into and out of the fluid reaction chamber to cause the positionable control device to rotate relative to the housing.

In automatically controlled embodiment of the present invention, a channel interconnects the fluid outlet of the pump to the fluid reaction chamber of the positionable control device to create an automatically controlled variable displacement gerotor pump.

BRIEF DESCRIPTION OF THE DRAWINGS

FIG. 3 is a fragmentary end view of the present invention with the positionable control device in the minimum flow position.

FIG. 4 is a fragmentary end view of the present invention with the positionable control device in the maximum flow position.

DETAILED DESCRIPTION

Figure 1:
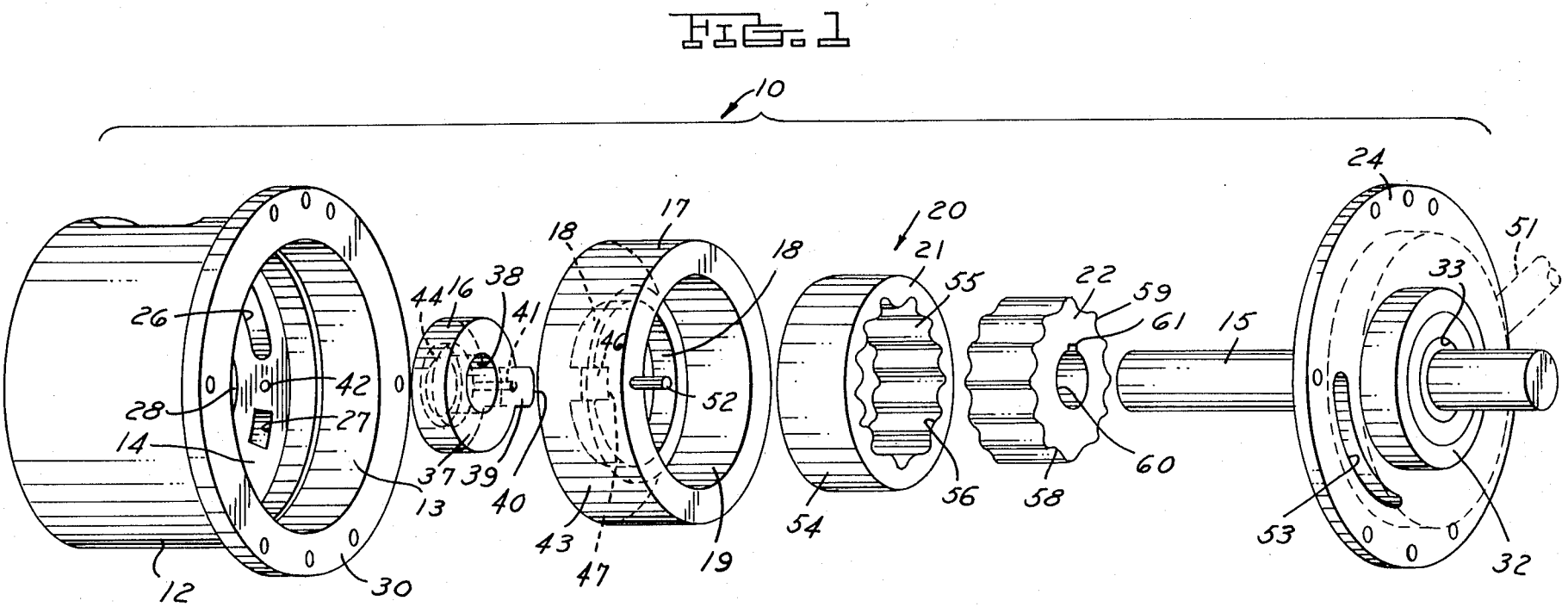
FIG. 1 is an exploded perspective view of a manually controlled variable displacement gerotor pump according to the present invention.

Referring now to the drawings, the variable displacement pump 10 includes a housing 12 having a centrally located cylindrical bore 13 extending partially through the housing 12. The end of the cylindrical bore comprises a port plate 14 through which hydraulic fluids are pumped. The pump-10 is powered by means of a drive shaft 15 which is centrally mounted within the cylindrical bore 13. A commutator or commutator member 16 is stationarily mounted on the port plate 14 to encirle the end of the cylindrical bore 13. A positionable control device, or variator, or variator member 17, is nested within the cylindrical bore 13 of the housing 12. The variator 17 includes a concentric inner surface 18 axially adjacent the port plate 14 and an eccentric inner surface, or eccentric bore 19, axially adjacent the concentric inner surface 18. A gerotor pump mechanism 20 is disposed within the eccentric bore 19 and comprises an outer rotor 21 and an inner rotor 22. The housing 12 is enclosed by a cover, or end plate 24, which holds the commutator 16, variator 17 and gerotor pump mechanism 20 together within the housing 12 in their operative relationship on the drive shaft 15.

Referring now to FIGS. 1, 2, 9 and 10, the housing 12 is shown to include an inlet port 26 which is in communication with a reservoir or source of fluid (not shown). The inlet port 26 is an arcuate opening formed through the port plate 14. The outlet port 27 is an opening formed in the port plate 14 spaced from the inlet port 26. The outlet port 27 is preferably smaller than the inlet port 26. The central bore 28 is formed in the center of the port plate 14 and extends through the housing 12. A ball bearing 29 is located in the housing to journal the drive shaft 15 for rotation in the central bore 28. The housing 12 includes a flange 30 at the open end of the cylindrical bore 13 for securing the cover plate 24 to the housing 12.

The cover plate 24 is provided to enclose the cylindrical bore 13 of the housing 12. The cover plate 24 is formed with an axial boss 32 to reinforce the cover plate 24 adjacent the bore 33 and to retain a bearing 34 which journals the drive shaft 15. The cover plate 24 is detachably secured to the flange 30 of the housing 12 by means of a plurality of bolts 35.

The commutator 16 is provided to block fluid flow from the inlet port 26 to the outlet port 27. Referring now to FIGS. 1, 2, 7 and 8, the commutator 16 includes an annular portion 37 having a bore 38 for encircling the drive shaft 15 and is located annularly adjacent to the port plate 14. A first lobe, or protrusion 39, extends radially outward from the annular portion 37 and includes a convex surface 40 at its radially outer end. The commutator 16 is held in place on the port plate 14 by means of a dowel pin 41 extending from the first lobe 39 into a hole 42 formed in the port plate 14 between the inlet port 26 and outlet port 27. The commutator 16 may include a cylindrical sleeve 44 protruding from the side of the commutator 16 and into an annular groove 45 formed in the port plate 14 about the periphery of the central bore 28. The dowel pin 41 and sleeve 44 being effective to hold the commutator 16 in place on the port plate 14.

The variator, or positionable control device 17, as shown in FIGS. 1, 2, 5 and 6, is a cylindrical member having a concentric inner surface 18 which is approximately equal in thickness axially to the commutator 16. The variator 17 includes a second lobe or protrusion 46 extending radially inwardly from the concentric surface 18 to contact the commutator 16. The second lobe 46 terminates in a concave end 47 that is machined to the same radius as the annular portion 37 to form a close tolerance fit therewith. The variator 17 is assembled into the housing 12 to be arcuately shiftable so that the second lobe 46 may move toward and away from the first lobe 39. The convex surface 40 of the first lobe 39 has the same radius as the concentric inner surface 18 of the variator 17 to form a seal therebetween.

Referring now to FIGS. 3 and 4, an arcuate inlet groove 48 is formed on the inlet port 26 side of the first and second lobes 39 and 46, and an arcuate outlet groove 49 is formed on the outlet port 27 side of the first and second lobes 39 and 46. The size of the arcuate inlet and outlet grooves 48 and 49 is variable depending upon the position of the variator 17. When the second lobe 46 is moved enlarging one of the arcuate grooves, the other arcuate groove is reduced in size commensurately. The arcuate outlet groove 49 may be reduced in size until it is substantially equal to the size of the outlet port 27, as when the pump is in the minimum flow position shown in FIG. 3. The arcuate outlet groove 49 may be enlarged until it is equal to the size of the inlet groove 48, as when the pump is in the maximum flow position shown in FIG. 4. A stop may be provided, as will be described subsequently, to prevent movement of the second lobe past the maximum flow position.

The central axis of the drive shaft 15 and the concentric inner surface 18 is shown in FIGS. 3, 4, 5, and 6 as axis "C". The central axis of the eccentric inner surface 19 of the variator 17 is indicated by the letter "E". The eccentric axis "E" is located on the opposite side of the central axis "C" from the second lobe 46. Hence, the second lobe 46 is located on the variator 17 where the concentric inner surface 18 and eccentric surface 19 are closest together. The inner and outer rotors 22 and 21 are held together by the variator adjacent the second lobe 46 in a closed mesh relationship, to form a closed mesh area 62, which is also referred to as the closed mesh crossover. The closed mesh area 62 of the rotors and second lobe 46 act to block fluid flow from the arcuate outlet groove 49 to the arcuate inlet groove 48.

Conversely, an open mesh area 63, or crossover point, is formed between the teeth of inner and outer rotors 22 and 21 where the inlet groove 48 and outlet groove 49 are separated by the first lobe 39 of the commutator 16. The open mesh crossover area 63 is the point at which fluid which has been drawn into the space between the inner and outer rotors 22 and 21 is transferred to the outlet groove 49 and then to the outlet port 27. The first lobe 39 is sized to prevent cross flow from the outlet groove 49 to the inlet groove 48 as the gerotor pump mechanism 20 is rotated relative to the lobe 39.

The present invention achieves variable displacement by repositioning the eccentric axis "E" of the outer rotor 21 relative to the axis "C" of the inner rotor 22. The volume of the space 50 at the open mesh crossover 63 is varied by changing the position of the variator 17 which rotates the second lobe 46 relative to the first lobe 39 while keeping the inlet and outlet grooves 48 and 49 separate. The volume of the space 50 is changed from a minimum, as shown in FIG. 3, to a maximum, as shown in FIG. 4.

Figure 2:
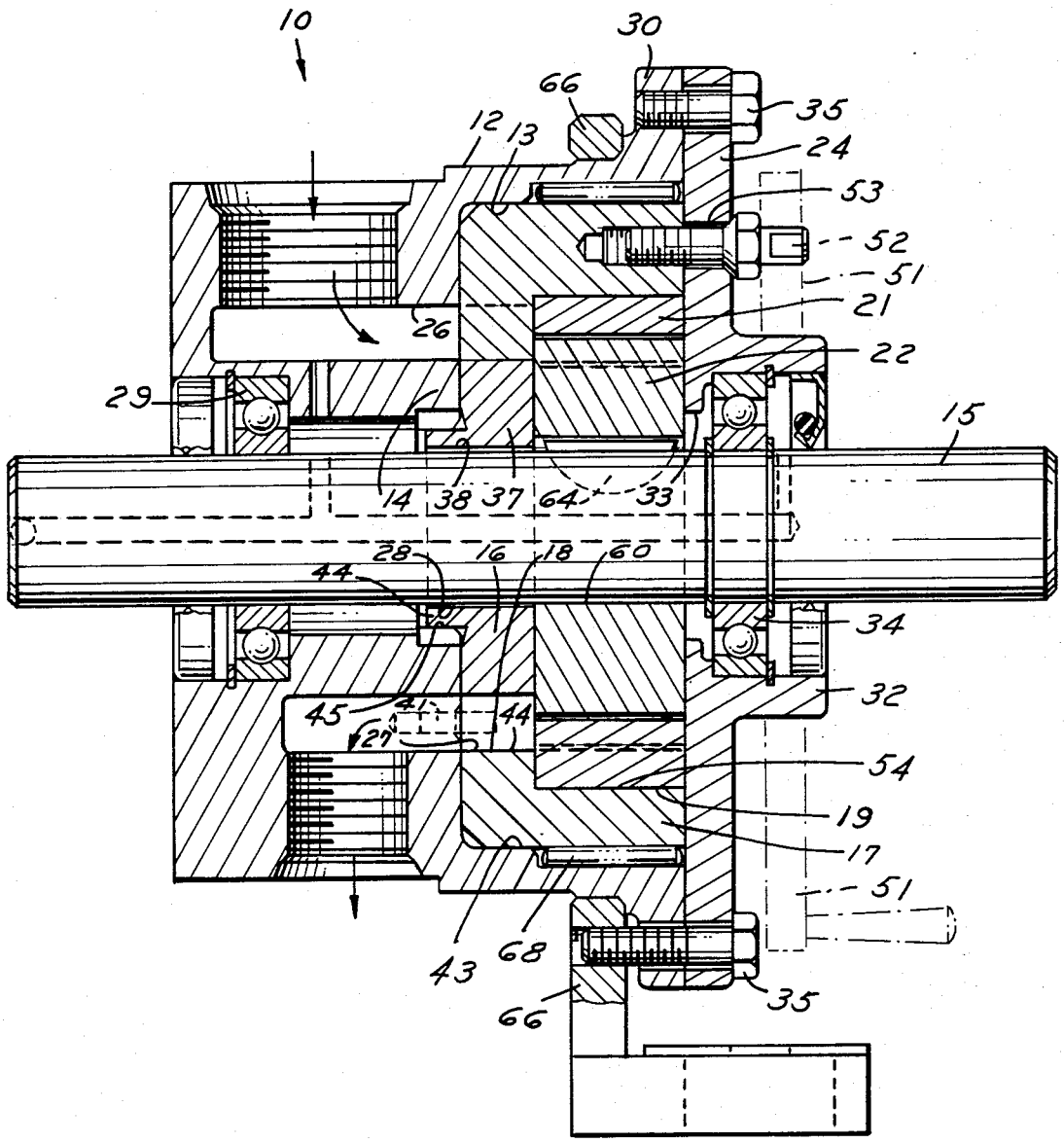
FIG. 2 is a sectional view of the present invention.
Figure 6:
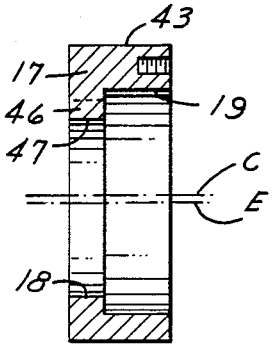
FIG. 6 is a cross-sectional view of the positionable control device taken along the line 6—6 in FIG. 5.
Figure 5:
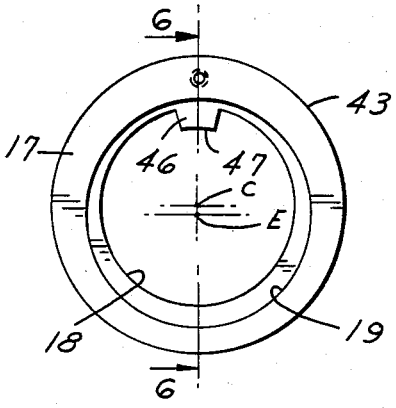
FIG. 5 is a plan view of the positionable control device of the present invention.
Figure 8:
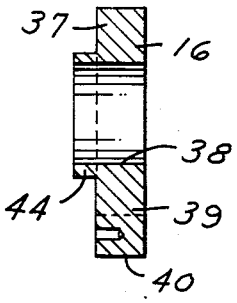
FIG. 8 is a cross-sectional view of the commutator taken along the line 8—8 in FIG. 7.
Figure 7:
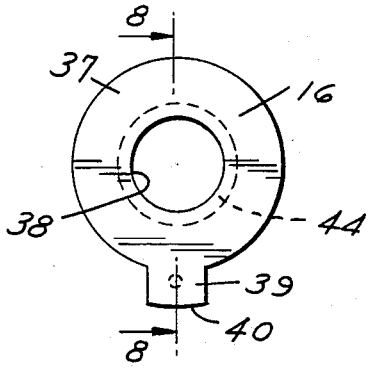
FIG. 7 is a plan view of the commutator of the present invention.
Figure 10:
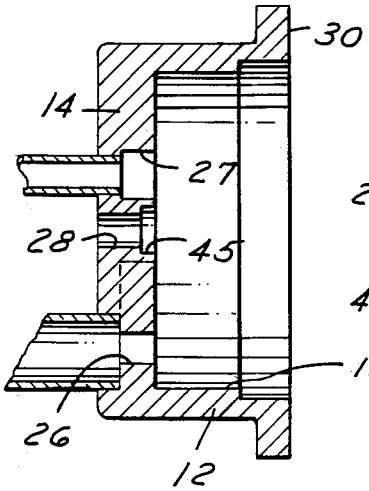
FIG. 10 is a cross-sectional view of the pump housing taken along the line 10—10 in FIG. 9.
Figure 9:
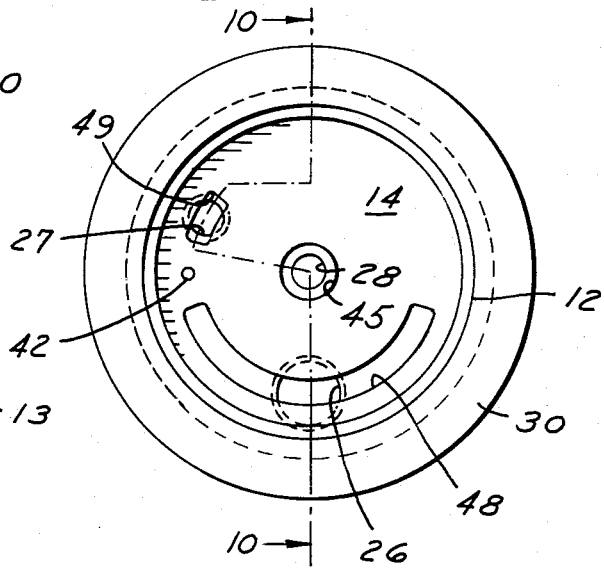
FIG. 9 is a plan view of the pump housing of the present invention.

In the manually shifted embodiment of the present invention, the position of the variator 17 is changed by moving a handle 51, shown in FIGS. 1 and 2. The handle 51 engages a dowel pin 52 which is secured to the variator and extends through an arcuate slot 53 in the cover plate 24. The ends of the arcuate slot 53 act as stops to limit the range of rotation of the variator 17 to the space between the inlet and outlet ports 26 and 27.

The outer rotor 21 of the gerotor pump mechanism 20 is nested within the eccentric inner surface 19 of the variator 17. The outer rotor 21 has a cylindrical outer surface 54 and an inner surface 55 having a plurality of convex arcuate gear teeth 56.

The inner rotor 22 is attached to the drive shaft 15 to be concentric therewith while being eccentric to the inner surface 55 of the outer rotor 21. The outer surface 58 of the inner rotor 22 includes a plurality of concave arcuate gear teeth 59 that are adapted to engage the convex gear teeth 56 of the outer rotor 21. As in conventional gerotor mechanisms the inner rotor has one less tooth than the outer rotor 21. A pumping action is created by the increasing and decreasing size of the clearance space between the inner and outer rotor 22 and 21 with the inlet and outlet ports 26 and 27 being isolated from one another. The inner rotor includes a concentric bore 60 having a keyway 61 by which the inner rotor is secured to the drive shaft 15, as shown in FIG. 2. A key 64 interconnects the drive shaft 15 to the inner rotor 22 so that the inner rotor rotates with the drive shaft 15.

In the disclosed embodiment, the entire gerotor pump assembly is mounted by means of a mounting bracket 66 which holds the pump stationary as the drive shaft 15 is rotated by a power source (not shown).

As with a conventional gerotor pump mechanism, the inner rotor 22 is rotated by the drive shaft 15 which in turn causes the outer rotor 21 to be rotated by the action of the gear teeth 56 and 59. Rotation of the outer rotor 21 is resisted by a frictional force developed between the cylindrical surface 54 and the eccentric inner surface 19 of the variator 17. If the inner and outer rotors 22 and 21 rotate in the clockwise direction, as viewed in FIG. 3, the frictional force between the cylindrical surface 54 and the eccentric inner surface 19 will tend to bias the variator 17 for rotation in the clockwise direction. Rotation of the variator 17 within the housing 12 is resisted by friction between the housing 12 and variator 17. If it is desirable to reduce the frictional force resisting rotation of the variator 17, roller bearings may be mounted between the housing and the variator to facilitate rotation of the variator relative to the housing. Roller bearings 68 are shown in FIGS. 2 through 4 to illustrate this variation.

Figure 11:
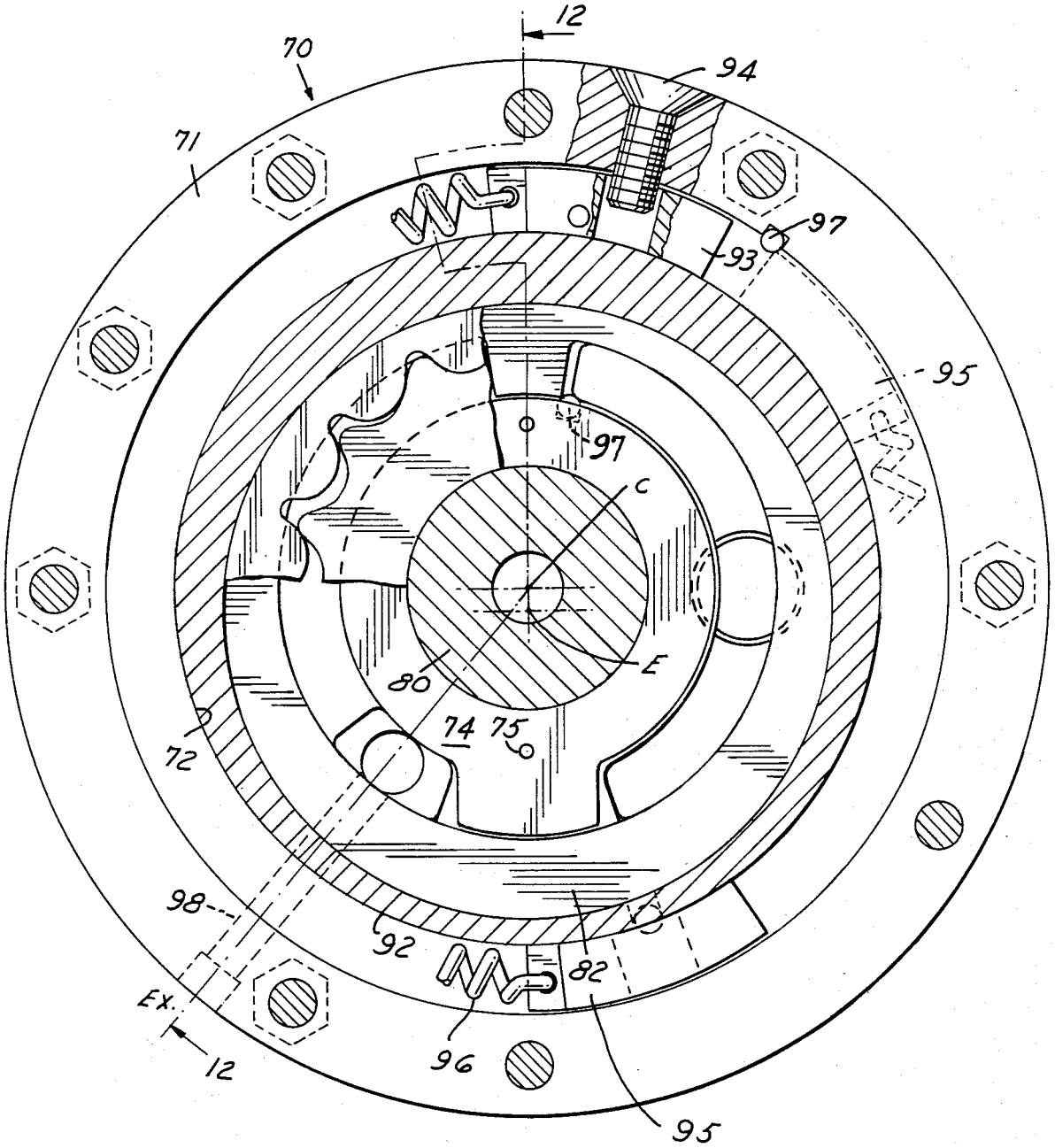
FIG. 11 is a fragmentary cross-sectional end view of a hydraulically controlled variable displacement pump made in accordance with a preferred embodiment of the present invention.
Figure 12:
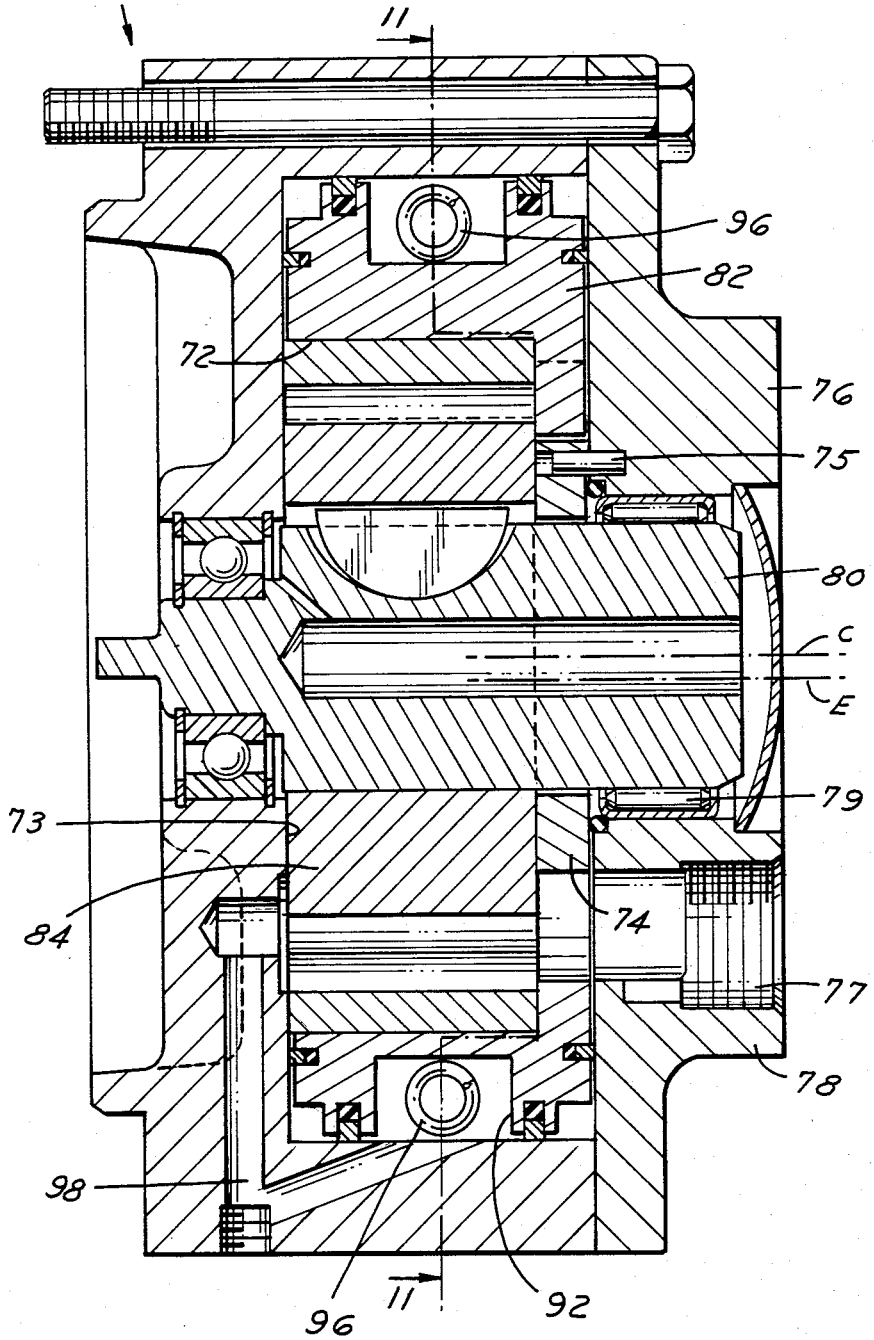
FIG. 12 is a cross-sectional view of the hydraulically controlled variable displacement pump shown in FIG. 11 taken along the line 12—12.

Referring now to FIGS. 11 and 12, an automatically adjusted variable displacement pump 70 is shown which includes a unique displacement adjustment mechanism. The automatically adjusted pump 70 permits the displacement of the pump to be adjusted according to the fluid demand of a hydraulic system. When the demand for hydraulic fluid increases, the reduction in pressure causes the pump output to be adjusted to provide additional displacement to compensate for the increase in demand. Conversely, when demand is reduced in the hydraulic system, the automatically adjusting variable displacement pump reduces the delivery of fluid through the pump.

The automatically adjusted variable displacement pump 70 includes a housing 71 which has a cylindrical bore 72 with a closed end 73. The internal elements of the variable displacement pump shown in FIGS. 11 and 12 are placed in the housing 71 in the inverse position as was described for the manual embodiment of FIGS. 1 through 10.

The commutator 74 has a dowel pin 75 extending from one side into cover plate 76, which also acts as the port plate of the pump 70. The outlet port 77 extends through the port plate 70, as shown in FIG. 12, and includes means for receiving a hydraulic fitting. The cover plate includes an axial boss 78 which retains a needle bearing set 79 for journaling one end of the shaft 80 for rotation.

The internal portions of the variator 82 and the gerotor 84 may be shaped the same as the manual embodiment previously described. The interaction of the variator 82, commutator 74, and gerotor 84 are preferably identical to the manual embodiment previously described and will not be repeated.

The variator 82 includes an annular groove, or chamber 92, formed in its outer cylindrical surface. A stationary reaction member 93 is positioned in the annular groove 92 and secured to the housing 71 by means of a screw or other fastener 94 as shown in FIG. 11. A shiftable reaction member 95 also located in the annular groove 92 and is attached to the variator 82. The stationary and shiftable reaction members 93 and 95 are interconnected by a spring, or biasing member 96, which is also preferably located in the annular groove 92.

The housing 71 includes a control fluid port 98 opening into the cylindrical bore 72 on the opposite side of the gerotor from the outlet port to communicate pressure changes in the outlet port 77 to the annular groove 92. The control fluid port 98 opens into the annular groove 92 between the stationary and shiftable reaction members 93 and 95 so that an increase in fluid pressure in the outlet port 77 causes the fluid pressure in the annular groove 92 to increase, forcing the shiftable reaction member 95 to move counterclockwise toward the position shown in phantom lines in FIG. 11. Movement of the shiftable reaction member causes the variator 82 to rotate toward the minimum flow position thereby causing the displacement of the pump to be reduced.

Movement of the variator 17 may be stopped by a ball stop 97 which is shown disposed in the wall of the housing 71 to contact the reaction member 95. Alternatively, a ball stop could be located on the commutator 74 adjacent the outlet port 77 to engage the lobe of the variator to prevent it from covering the outlet port 77. In some applications it is anticipated that the lobe of the variator would be permitted to move over the outlet port 77.

Movement of the shiftable reaction member 95 is opposed by the spring 96, so that when there is a reduction in fluid pressure in the outlet port 77, as would be caused by the opening of a valve in the hydraulic system (not shown) supplied by the outlet port 77, the shiftable reaction member 95 rotates in the clockwise direction as viewed in FIG. 11 from the position in phantom toward the original position. This movement of the shiftable reaction member 95 causes the variator to rotate from the minimum flow position toward the maximum flow position.

Movement of the shiftable reaction member 95 is also opposed by the frictional force resisting rotation of the outer rotor 21 within the variator 17. In some applications, the frictional force applied by the cylindrical surface 54 to the eccentric inner surface 19 will be sufficient to bias the variator toward the maximum flow position. The frictional drag between the outer rotor 21 and the variator 17 combined with the action of the spring 96 tends to shift the pump to maximum displacement when the pump is started in the disclosed embodiment. Maximum flow at start up is desirable so that the hydraulic system will be quickly pressurized to the proper operating pressure.

It should be understood that the extent to which the shiftable reaction member 95 shifts is dependent upon the degree of change in pressure in the outlet port 77. The maximum flow position is established by a ball stop 97 which engages the second lobe 46 of the variator 17 to prevent movement past the maximum flow position which would permit cross flow of fluid from the arcuate outlet groove 49 to the arcuate inlet groove 48.

It should be understood that a conventional hydraulic control system can be used to hydraulically control the displacement of the pump by simply connecting a hydraulic line to a control fluid port 98 that is not open to the cylindrical bore 72. In such a system injection or withdrawal of hydraulic fluid from the annular groove 92 could be controlled from a remote location to selectively increase or decrease the displacement of the pump.

OPERATION

Operation of the manually controlled variable displacement pump will be described with reference to FIGS. 1 through 4. The displacement of the pump 10 is controlled by shifting the handle 51 to move the pin 52 in the arcuate slot 53. The pin 52 in turn shifts the variator 17 radially to rotate the eccentric axis "E" of the eccentric bore 19 about the central axis "C". The second lobe 46 is simultaneously shifted toward the first lobe 39 reducing the size of the annular outlet groove 49 and simultaneously increasing the size of annular inlet groove 48. Shifting the eccentric axis "E" causes the closed mesh area 62 of the inner and outer rotor to be rotated from the position shown in FIG. 3 toward the position shown in FIG. 4.

In the maximum flow position shown in FIG. 4, the fluid taken from the annular inlet groove 48 is enclosed in the space 50 between adjacent teeth of the inner rotor and outer rotor as they move across the first lobe 39. This action is commonly referred to as (open mesh) crossover and it is at this zone that any fluid that has been drawn into the space between the inner and outer rotors 22 and 21 is transferred from the inlet groove 48 to the outlet groove 49. It should be noted that the space 50 between the inner and outer rotors 22 and 21 adjacent the first lobe in the maximum flow position, as shown in FIG. 4, is several times larger than the space 50 adjacent the first lobe in the minimum flow position, as shown in FIG. 3, consequently, the amount of displacement per revolution may be radically changed.

Operation of the automatically adjusted variable displacement pump 70 will next be described with reference to FIGS. 11 and 12. The operation of the variable gerotor pumping mechanism is identical to that described in the manual embodiment and will not be described further because the shifting of the variator 82 results in the same inneraction between the gerotor and the inlet and outlet ports.

With that in mind, shifting the automatically adjusting variable displacement pump will be described. For illustration purposes, the system will be described as starting in its maximum flow position as shown in solid lines in FIG. 11. In this position, similar to that shown in FIG. 4, the maximum amount of fluid is transferred by the gerotor.

If the demand for fluid is reduced, such as by the closing of a hydraulic valve downstream from the outlet port 77, the pressure within the outlet port and between the inner and outer rotors and in the control fluid port 98 will increase. The increase in pressure is transferred to the annular groove 92 and is exerted on the shiftable reaction member 95 to overcome the resistance of the biasing member 96. The shiftable reaction member 95 is then moved in the counterclockwise direction, as shown in FIG. 11, from the position shown in solid lines to the position shown in phantom lines. By shifting the shiftable reaction member 95 the variator is shifted to a reduced flow position.

If a demand is then placed on the outlet by the opening of a valve to a hydraulic device such as a cylinder, the pressure in the outlet port 77, and between the inner and outer rotors will likewise be reduced. This reduction in pressure is communicated to the annular groove 92 through the control fluid port 98. When the pressure within the annular groove 92 is reduced the shiftable reaction member 95 will be reacted on by the spring 96 in the clockwise direction to rotate the variator 82 toward an increased flow position. If the demand on the system is great enough, the variator will shift to the maximum flow position wherein the second lobe moves to the position diametrically opposed to the first lobe, until it contacts the ball stop 97.

It should be understood that the above description is to be taken by way of example and not by way of limitation and that the present invention should be interpreted in accordance with the following claims.

I claim:

1. In a variable displacement gerotor pump comprising:

a housing having a bore and a cover at one end;

a fluid inlet port and a fluid outlet port opening into the bore of the housing;

a commutator member having an annular portion with a first crossover element extending radially outwardly from the annular portion, said commutator member with said first crossover element being located between the fluid inlet port on one side and the fluid outlet port on an opposite side;

a variator member in said housing having a first inner surface centered relative to said bore and having a second crossover element extending radially inwardly from the first inner surface, and a second inner surface axially adjacent said first inner surface and being eccentric relative to the bore with the central axis of the second inner surface being offset from the central axis of the bore away from said second crossover element;

means for fixing one of said members to said housing;

said first crossover element engaging said first inner surface of the variator member and the second crossover element engaging said annular portion of the commutator member to separate the fluid inlet and outlet ports;

control means for arcuately shifting and thereby moving the other of said members from a maximum flow position to a minimum flow position;

a gerotor adapted to nest within the second inner surface of said variator member; and a drive shaft secured to the gerotor and being effective to rotate the gerotor for drawing a fluid through the fluid inlet port on said one side of the first crossover element and discharging said fluid through the fluid outlet port on said opposite side of the first crossover element whereby displacement of said pump is varied by shifting and thereby moving the other of said members between the maximum and minimum flow positions.

2. The variable displacement gerotor pump of claim 1 wherein said one member which is fixed is said commutator member and said other of said members which is movable is said variator member.

3. The variable displacement gerotor pump of claim 1 wherein said fluid intake port is larger than said fluid outlet port.

4. The variable displacement gerotor pump of claim 2 wherein the control means comprises a handle connected to the variator member through an arcuate slot formed in said cover.

5. The variable displacement gerotor pump of claim 2 wherein the control means comprises:

a stationary reaction member on the inner surface of said housing;

a rotatable reaction member on the variator member;

a fluid reaction chamber formed by the housing and the variator member and bounded on opposite ends by the stationary reaction member and the rotatable reaction member; and channel means formed through said housing for supplying and withdrawing fluid to the fluid reaction chamber to rotate said variator member relative to the housing.

6. The variable displacement gerotor pump of claim 5 wherein a spring is interposed between the stationary reaction member and the rotatable reaction member, said spring yieldable biasing the variator member for rotation relative to the housing, tending to resist rotation of the variator member caused by supplying pressurized fluid to the fluid reaction chamber and tending to rotate the variator member in the opposite direction to assist withdrawing fluid therefrom when fluid pressure in the chamber is reduced.

7. In a variable displacement gerotor pump comprising:

a pump housing having a cylindrical bore with a port plate at one end and a cover on the opposite end;

a fluid inlet port and a fluid outlet port formed in the port plate with said fluid inlet port being larger than the fluid outlet port;

a commutator member having an annular portion with a first crossover lobe extending radially outwardly from the annular portion, said commutator member with said first crossover lobe being located between the fluid inlet port and the fluid outlet port;

a variator member in the pump housing having a first cylindrical inner surface centered relative to said bore and having a second crossover lobe extending radially inwardly from the first cylindrical inner surface, and a second cylindrical inner surface axially adjacent the first cylindrical surface and being eccentric relative to the cylindrical outer surface with the central axis of the second cylindrical surface being offset from the central axis of the cylindrical outer surface away from the second crossover lobe;

means for fixing one of said members to said housing;

said first crossover lobe of the commutator member being sized to sealingly engage the first inner cylindrical surface of the variator member, and the second crossover lobe being sized to sealingly engage the annular portion of the commutator member;

control means for shifting and thereby moving the other of said members and its crossover lobe from a maximum flow position wherein the crossover lobe is located diametrically opposite the other crossover lobe of said fixed member to a minimum flow position wherein the crossover lobe of the movable member is immediately adjacent the opposite side of the fluid outlet port from the crossover lobe of the fixed member;

an outer gerotor having an outer cylindrical surface adapted to nest within the second cylindrical inner surface of the variator member, and an inner surface defining a plurality of arcuate gear teeth;

an inner gerotor having an outer surface defining a plurality of arcuate gear teeth; and a drive shaft secured to the inner gerotor and being adapted to be rotated by a power source, said drive shaft being effective to rotate the inner gerotor relative to the outer gerotor causing a fluid to be drawn through the fluid inlet port between the inner and outer gerotor on the inlet side of the crossover lobe of the fixed member and causing said fluid to be discharged through the fluid outlet port from between the inner and outer gerotor on the outlet side of the crossover lobe of the fixed member, whereby the displacement of said pump is varied by the control means shifting and thereby moving the other of said members between the maximum and minimum flow positions.

8. The variable displacement gerotor pump of claim 7 wherein said one member which is fixed is said commutator member and said other of said members which is movable is said variator member.

9. The variable displacement gerotor pump of claim 8 wherein the control means comprises a handle connected to the variator member through an arcuate slot formed in said cover.

10. The variable displacement gerotor pump of claim 8 wherein the control means comprises:

a stationary reaction member on the inner surface of said housing;

a rotatable reaction member on the variator member;

a fluid reaction chamber formed by the housing and the variator member and bounded on opposite ends by the stationary reaction member and the rotatable reaction member; and channel means formed through said housing for supplying and withdrawing fluid to the fluid reaction chamber to rotate said variator member relative to the housing.

11. The variable displacement gerotor pump of claim 10 wherein a spring is interposed between the stationary reaction member and the rotatable reaction member, said spring yieldably biasing the variator member for rotation relative to the housing, tending to resist supplying fluid to the fluid reaction chamber and assist withdrawing fluid therefrom.

12. In a variable displacement gerotor pump comprising:

a housing having a bore and a removable cover at one end;

a fluid inlet port and a fluid outlet port opening into the bore of the housing;

a commutator having an annular portion with a first crossover element extending radially outwardly from the annular portion, said commutator being secured to the port plate with the first crossover element being located between the fluid inlet port on one side and the fluid outlet port on an opposite side;

a variator nested within the bore of the housing and being arcuately shiftable therein, a first inner surface being centered relative to the bore and having a second crossover element extending radially inwardly from the first inner surface, and a second inner surface axially adjacent the first inner surface and being eccentric relative to the bore with the central axis of the second inner surface being offset from the central axis of the bore away from the second crossover element;

said first crossover element engaging the first inner surface of the variator, and the second crossover element engaging the annular portion of the commutator to separate the fluid inlet and outlet ports;

control means for arcuately shifting the variator from a maximum flow position to a minimum flow position;

a gerotor adapted to nest within the second inner surface of the variator; and a drive shaft secured to the gerotor and being effective to rotate the gerotor for drawing a fluid through the fluid inlet port on said one side of the first crossover element and discharging said fluid through the fluid outlet port on said opposite side of the first crossover element whereby displacement of said pump is varied by shifting the variator between the maximum and minimum flow positions.

13. The variable displacement gerotor pump of claim 12 wherein said fluid intake port is larger than said fluid outlet port.

14. The variable displacement gerotor pump of claim 12 wherein the control means comprises a handle connected to the variator through an arcuate slot formed in said cover.

15. The variable displacement gerotor pump of claim 12 wherein the control means comprises:

a stationary reaction member on the inner surface of the housing;

a rotatable reaction member on the variator;

a fluid reaction chamber formed by the housing and the variator and bounded on opposite ends by the stationary reaction member and the rotatable reaction member; and channel means formed through said housing for supplying and withdrawing fluid to the fluid reaction chamber to rotate the variator relative to the housing.

16. In the variable displacement gerotor pump of claim 15 a spring interposed between the stationary reaction member and the rotatable reaction member, said spring yieldably biasing the variator for rotation relative to the housing, tending to resist rotation of the variator caused by supplying pressurized fluid to the fluid reaction chamber and tending to rotate the variator in the opposite direction to assist withdrawing fluid therefrom when fluid pressure in the chamber is reduced.

17. In a variable displacement gerotor pump comprising:

a pump housing having a cylindrical bore with a port plate at one end and a removable cover on the opposite end;

a fluid inlet port and a fluid outlet port formed in the port plate with said fluid inlet port being larger than the fluid outlet port;

a commutator having an annular portion with a first crossover lobe extending radially outwardly from the annular portion, said commutator being secured to the port plate with the first crossover lobe being fixedly located between the fluid inlet port and the fluid outlet port;

a positionable control device having a cylindrical outer surface adapted to nest within the cylindrical bore of the pump housing and being arcuately shiftable therein, a first cylindrical inner surface being concentric with the cylindrical outer surface and having second crossover lobe extending radially inwardly from the first cylindrical inner surface, and a second cylindrical inne r surface axially adjacent the first cylindrical surface and being eccentric relative to the cylindrical outer surface with the central axis of the second cylindrical surface being offset from the central axis of the cylindrical outer surface away from the second crossover lobe;

said first crossover lobe of the commutator being sized to sealingly engage the first inner cylindrical surface of the positionable control device, and the second crossover lobe being sized to sealingly engage the annular portion of the commutator;

control means for shifting said second crossover lobe from a maximum flow position wherein the second crossover lobe is located diametrically opposite the first crossover lobe to a minimum flow position wherein the second crossover lobe is immediately adjacent the opposite side of the fluid outlet port from the first crossover lobe;

an outer gerotor having an outer cylindrical surface adapted to nest within the second cylindrical inner surface of the positionable control device, and an inner surface defining a plurality of arcuate gear teeth;

an inner gerotor having an outer surface defining a plurality of arcuate gear teeth; and a drive shaft secured to the inner gerotor and being adapted to be rotated by a power source, said drive shaft being effective to rotate the inner gerotor relative to the outer gerotor causing a fluid to be drawn through the fluid inlet port between the inner and outer gerotor on the inlet side of the first crossover lobe and causing said fluid to be discharged through the fluid outlet port from between the inner and outer gerotor on the outlet side of the first crossover lobe, whereby the displacement of said pump is varied by the control means shifting the positionable control device between the maximum and minimum flow positions.

18. The variable displacement gerotor pump of claim 17 wherein the control means comprises a handle connected to the variator through an arcuate slot formed in said cover.

19. The variable displacement gerotor pump of claim 17 wherein the control means comprises:

a stationary reaction member on the inner surface of the housing;

a rotatable reaction member on the variator;

a fluid reaction chamber formed by the housing and the variator and bounded on opposite ends by the stationary reaction member and the rotatable reaction member; and channel means formed through said housing for supplying and withdrawing fluid to the fluid reaction chamber to rotate the variator relative to the housing.

20. In the variable displacement gerotor pump of claim 19 a spring interposed between the stationary reaction member and the rotatable reaction member, said spring yieldably biasing the variator for rotation relative to the housing, tending to resist supplying fluid to the fluid reaction chamber and assist withdrawing fluid therefrom.

* * * * *